US006219991B1

(12) United States Patent
Salek-Nejad

(10) Patent No.: US 6,219,991 B1
(45) Date of Patent: Apr. 24, 2001

(54) METHOD OF EXTERNALLY STRENGTHENING CONCRETE COLUMNS WITH FLEXIBLE STRAP OF REINFORCING MATERIAL

(75) Inventor: Hossein Salek-Nejad, Tucson, AZ (US)

(73) Assignees: Hexcel Corporation, Dublin; Fyfe Company, L.L.C., San Diego, both of CA (US)

( * ) Notice: Subject to any disclaimer, the term of this patent is extended or adjusted under 35 U.S.C. 154(b) by 0 days.

(21) Appl. No.: 07/767,405

(22) Filed: Sep. 30, 1991

Related U.S. Application Data

(63) Continuation-in-part of application No. 07/563,531, filed on Aug. 6, 1990.

(51) Int. Cl.[7] ..... E04C 3/34

(52) U.S. Cl. ..... 52/741.3; 52/721.4; 52/745.17; 156/71; 156/172; 264/32; 264/36.2

(58) Field of Search ..... 52/722, 723, 724, 52/725, 514, 600, 745.17, 745.18, 741.3; 405/216; 264/3.6, 135, 228, 229, 32; 156/71, 94, 191, 187, 172

(56) References Cited

U.S. PATENT DOCUMENTS

| | | | | |
|---|---|---|---|---|
| 3,429,758 | | 2/1969 | Young . | |
| 3,551,237 | | 12/1970 | Cox et al. . | |
| 3,813,098 | * | 5/1974 | Fischer et al. | 52/727 |
| 4,019,301 | | 4/1977 | Fox . | |
| 4,023,374 | | 5/1977 | Colbert et al. . | |
| 4,068,483 | * | 1/1978 | Papworth | 405/216 |
| 4,244,156 | * | 1/1981 | Watts, Jr. | 405/216 |
| 4,283,238 | * | 8/1981 | Jacquemart | 156/94 |
| 4,439,070 | | 3/1984 | Dimmick . | |
| 4,439,071 | * | 3/1984 | Roper, Jr. | 405/216 |
| 4,676,276 | | 6/1987 | Fawley . | |
| 4,700,752 | | 10/1987 | Fawley . | |
| 4,764,054 | | 8/1988 | Sutton . | |
| 4,786,341 | | 11/1988 | Kobatake et al. . | |
| 4,892,601 | * | 1/1990 | Norwood | 405/216 |

FOREIGN PATENT DOCUMENTS

| | | | | |
|---|---|---|---|---|
| 9039431 | * | 11/1979 | (JP) | 156/187 |
| 4201550 | * | 7/1992 | (JP) | 156/187 |

OTHER PUBLICATIONS

Fardis, M., et al., "FRP–encased Concrete as a Structural Material", Magazine of Concrete Research: vol. 34, No. 121, Dec. 1982, pp. 191–202.

Bernards et al "Seismic Retrofit of Bridge Columns" pp. 187–190 Oct. 29–30, 1990, Bridge Engr. Research in Progress Workshop.

Priestley et al, "Steel Jacketing of Bridge Columns For Enhanced Flexural Performance" pp. 205–208, Oct. 29–30, 1990, Bridge Engr. Research in Process Workshop.

* cited by examiner

*Primary Examiner*—Michael Safavi
(74) *Attorney, Agent, or Firm*—Finnegan, Henderson, Farabow, Garrett, Dunner, L.L.P.

(57) ABSTRACT

A method of repairing and strengthening a concrete column includes wrapping a flexible strap of reinforcing material circumferentially around the exterior of a concrete column and longitudinally along at least a portion of the height of the concrete column, and then fastening the flexible strap of reinforcing material to itself to secure it to the concrete column such that external lateral reinforcement of the concrete column is thereby provided which increases the strength, stiffness and ductility of the concrete column. The repairing and strengthening method also includes applying a tension force to the flexible strap of reinforcing material before, while, or after it is wrapped around the exterior of the concrete column. The flexible strap of reinforcing material has a predetermined length, width and thickness. The length of the flexible strap of reinforcing material is at least greater than the circumference of the concrete column, while the width of the strap of reinforcing material is substantially greater than thickness thereof.

41 Claims, 6 Drawing Sheets

METHOD OF EXTERNALLY STRENGTHENING CONCRETE COLUMNS WITH FLEXIBLE STRAP OF REINFORCING MATERIAL

CROSS-REFERENCE TO RELATED APPLICATION

This application is a continuation-in-part of copending U.S. patent application Ser. No. 563,531, filed Aug. 6, 1990.

BACKGROUND OF THE INVENTION

1. Field of the Invention

The present invention generally relates to repairing and strengthening internally-reinforced concrete columns of structures and, more particularly, is concerned with a method of externally repairing and strengthing such columns in existing and new structures with a flexible strap of reinforcing material to increase the strength, stiffness and ductility thereof.

2. Definition of Terms

By way of definition, the term "concrete column", as used herein, is meant to refer to a structural element of a structure, where the structural element is hollow or solid and composed of internally-reinforced concrete primarily subjected to axial force, shear force, and bending moment. The term is synonymous with a bridge pier, pile, pillar, and post. The term also includes regions where beams or floor slabs frame into the column which are known in the art as joints or connections.

The term "structure" is meant to refer to any constructed facility wherein concrete is used, including, but not limited to, buildings, bridges, parking garages, factories, harbors and ports.

The term "repair" is meant to refer to the addition to or alteration of an existing structure for improved structural performance. The term "strengthening" is meant to refer to the addition to or alteration of an existing structure for the purpose of increasing the strength of the structure beyond its original value.

The term "strength" is meant to refer to ability to resist axial forces, shear forces, and bending forces. The term "stiffness" is meant to refer to the resistance to cracking and deformation. The term "ductility" is meant to refer to the ability of the structure to undergo permanent deformation prior to failure.

3. Description of the Problem

As known to those skilled in this art, a typical concrete column is internally reinforced with steel. Basically, the concrete column contains two types of steel reinforcement, as shown in FIGS. 1 through 6.

One type is a longitudinal steel reinforcement in the form of individual longitudinal rods or bars 10 which are spaced apart and placed internally along the length of the concrete column. The other type is a lateral steel reinforcement which is placed internally in substantially parallel relation to the exterior surface of the concrete column. The lateral steel reinforcement can be either in the form of individual rectangular hoops or ties 12, circular ties 14, or a continuous one-piece spiral rod 16.

The function of lateral reinforcement is to increase the shear strength of the concrete column and to provide confinement for the concrete 18 and lateral support for the longitudinal bars 10 to prevent them from buckling under large axial loads. Depending on the cross-sectional geometry of the concrete column, other shapes of lateral steel reinforcement can be used.

A variation of the above-described internally-reinforced concrete columns is one known to those skilled in the field as a "composite column", shown in FIGS. 7 and 8. The composite column is composed of a wide-flange steel beam 20, being H-shaped in cross-section, which is encased in the concrete column.

Concrete columns may require either repair or strengthening or both for various reasons. The repair or strengthening may call for the addition of external longitudinal or lateral steel reinforcement, or both of these. The reasons such repair or strengthening is needed include, but are not limited to, the following:

A. Seismic repair or strengthening

Many structures exist today which are not capable of resisting loads imposed on them during an earthquake. This is partly because when these structures were originally designed, little was known about how to design a structure to resist earthquake loads safely. As a result, many reinforced concrete columns in existing structures have insufficient longitudinal or lateral steel reinforcement or contain poorly-detailed steel reinforcement. Such concrete columns are unsafe in the event of an earthquake and therefore they need to be repaired or strengthened.

B. Gradual deterioration of structure

This deterioration could result from adverse environmental effects such as corrison of steel, salt spray, fire damage, hurricanes, tornadoes and the like. In such cases, the concrete column loses its design strength due to spalling of concrete and corrosion of reinforcement. Therefore, it is desirable to repair or strengthen these columns so that their strength is upgraded to at least that of the original capacity. This is a common problem with concrete columns in many aging structures.

C. Functional changes

In some structures, the introduction of heavier loads requires upgrading of load carrying capacity of concrete columns beyond their original design strength. For example, in order for older bridges to carry today's heavier trucks and traffic volumes, the strength of concrete columns must be increased beyond their original values.

D. Increased shear strength

Concrete columns in some existing structures may lack sufficient lateral steel reinforcement to withstand shear forces. In such cases, additional lateral reinforcement is needed to increase the shear strength of these concrete columns.

E. Increased ductility

In general, concrete columns with sufficient lateral steel reinforcement fail in a ductile manner, that is, they can resist large permanent deformations before they fail. Thus, repair and strengthening in the form of addition of lateral reinforcement may be desirable to increase the ductility of existing concrete columns.

F. Construction errors

Repair or strengthening may be required to correct some construction errors in a fairly new structure where, by mistake, some of the required reinforcement has been omitted or misplaced during the construction.

G. Increased factor of safety

Strengthening of some structures can be performed primarily for increasing the factor of safety against failure.

When repair or strengthening is required, it is necessary to employ the most cost effective technique. In selecting the appropriate repair or strengthening method, such factors as the original repair or strengthening cost and time required, future maintenance cost, expected life of the repaired or strengthened concrete column and the structure, availability of the repairing or strengthening materials, the ratio of the additional strength to cost, etc., should be considered.

For most concrete columns, the primary interest in repair or strengthening lies in providing additional confinement in the form of lateral reinforcement. Since it is not practical to add internal lateral reinforcement to an existing concrete column, some form of external lateral reinforcement is typically utilized.

4. Description of the Prior Art

Up to the present time, several methods known to those skilled in this art have been used to externally repair and strengthen internally-reinforced concrete columns in existing structures. These strengthening methods include, but are not limited to, the following:

1. Steel encasement

This strengthening method, also called steel jacketing, involves the building of a loosely-fitting steel case around an existing reinforced concrete column. The case is constructed of thin steel sheets and fully encloses the concrete column. The gap between the case and the column is then filled with pressurized grouting mortar.

2. Steel straps and angles

In this method of strengthening, steel angles are placed at corners of rectangular concrete columns along the full height of the column. Thin rectangular steel pieces are welded to the angles around the periphery of the column at specified elevations along the height of the column. This will create an encasing cage around the concrete column which will improve its structural response in the event of an earthquake.

3. Steel wire fabric

Welded wire fabrics in the form of orthogonal steel wires are placed around the periphery of the concrete column along the full height. A layer of fresh concrete is then cast on the wires around the column. This increases the cross-sectional area of the column and therefore its overall strength.

4. Closely-spaced external steel ties

This strengthening method is similar to strengthening with steel wire fabrics. Loosely-fitted steel ties are placed around the concrete column along its height. Concrete overlays are then cast on the ties to increase the size and therefore the strength of the concrete column beyond its original capacity.

5. High-strength steel wire

In this method, high-strength steel wires or strands are wrapped around the concrete column to enhance the ductility and strength of the column.

Although the above-described external strengthening methods help increase the strength and ductility of existing internally-reinforced concrete columns, they have several major shortcomings as follows:

A. Economy

These strengthening methods are all very labor-intensive and difficult to implement in the field. For example, they require field welding of steel, formwork for casting of additional concrete, and transportation of heavy equipment and concrete to the site.

B. Aesthetics

These strengthening methods will result in a significant alteration of the existing columns and may be objectionable and unsightly.

C. Applicability

Most of the strengthening methods described above are only suitable for application to prismatic members. For concrete columns whose cross-sectional size and shape vary along the height, these methods of strengthening could be hard or impossible to apply in the field.

D. Corrosion

The methods of strengthening by using steel encasement, steel straps and angles, and high-strength steel wire require further long-term protective measures to insure durability of steel casing against corrosion.

E. Size

The strengthening methods described above invariably result in an increase in the size of the concrete column. This will reduce the available floor space in buildings and adds to the self-weight of the structure.

F. Serviceability

The methods of strengthening described above enhance the response of the concrete column at the incipient of failure only. The serviceability of the concrete column would improve if the column could be laterally prestressed. Most of the above methods are not suitable for applying lateral prestress to the column.

G. Post-Earthquake inspection

Most of the methods described above fully cover the original concrete column. Consequently, after an earthquake, it will be impossible to inspect the extent of damage sustained by the column.

An alternative method, different from the prior art methods described above, which is asserted to provide concrete columns with sufficient lateral reinforcement in shear strength to be durable against earthquakes is disclosed in U.S. Pat. No. 4,786,341 to Kobatake et al. This patent discloses that, in accordance with the Kobatake et al method, a flexible reinforcing fiber strand is applied on the outer periphery of a concrete structural member, such as an existing concrete column, by spiraling winding the reinforcing fiber strand around the concrete structural member's outer periphery while impregnating the material of the reinforcing fiber strand with a resin. After the winding is completed, the patent discloses that the reinforcing fiber strand is pressed to expand it into a tape-like form having a certain large breath. By so doing, the patent discloses that the contact area of the reinforcing fiber strand increases, which relaxes the stress concentration, and delays the breakage of the reinforcing fiber strand.

The patent also discloses that the reinforcing fiber strand used in the Kobatake et al method can be a high strength strand in which about 6000 carbon fiber monofilaments are bundled and impregnated with a resin. The number of filaments may be adjusted. Alternatively, the reinforcing strand is disclosed as being formed of glass fiber or metal wire.

Also, in the Kobatake et al patent, it is disclosed that an insulating member can be interposed in an non-adhesive manner between the reinforcing fiber strand and the outer periphery of the concrete structural member. The patent mentions that the insulating material used should be one that will produce sliding between the concrete structural member and the insulating member or between the insulating member and the reinforcing fiber strand, or both.

In one example of the Kobatake et al method, the patent discloses that at the start of the winding operation the reinforcing fiber strand is first wound in a single winding turn around the outer periphery of the column in a direction orthogonal to the axis of the column to thereby form a hoop. After its starting end is bonded to the hoop by an adhesive, the reinforcing fiber strand is then spirally wound toward the upper end of the column. When it has reached the upper end of the column, the reinforcing fiber strand is again wound in a single winding turn in the direction orthogonal to the axis of the column to thereby form another hoop, and the terminal end of the reinforcing fiber strand is bonded to this latter hoop by an adhesive.

In this manner, the Kobatake et al patent discloses that, since it is possible to spirally wind the reinforcing fiber strand around the column by first bonding the starting end of the reinforcing fiber strand to the bottom hoop, it is thereby possible to impart a tensile force to the reinforcing fiber strand from the beginning and to provide the wound reinforcing fiber strand free from slackening or loosening, and hence in tight contact with the surface of the column. The Kobatake et al patent asserts that, since no tensile force is lost by bonding the terminal end of the reinforcing fiber strand to the top hoop, it is possible to realize the spiral winding of the reinforcing fiber strand free from the slackening or loosening. Also, since the reinforcing fiber strand is tightly wound around the column, the Kobatake et al patent asserts that the column receives the high binding force of the reinforcing fiber strand, whereby sufficient reinforcement is provided against earthquakes.

While the reinforcement method of the Kobatake et al patent may constitute a step in the right direction toward the goal of finding an adequate solution to the problem of how to repair and strengthen concrete columns, it appears to fall considerably short of achieving that goal. The winding of a reinforcing fiber strand around the concrete column would appear to be a time-consuming and tedious operation and produce concentrations of stress along the lines of contact of the fiber strand with the concrete column which would likely result in premature failure of the fiber strand and thereby of the external reinforcement provided by the strand.

Consequently, a need still urgently exists for a satisfactory approach for repairing and strengthening concrete columns.

SUMMARY OF THE INVENTION

The present invention provides a method of repairing and strengthing a concrete column which is designed to overcome the above-described problems and to satisfy the aforementioned needs. The external repairing and strengthening method of the present invention is applicable to concrete columns in both existing and new structures. The method employs a flexible strap of reinforcing material which, when wrapped about the internally-reinforced concrete column in accordance with the method of the present invention, sufficiently upgrades or increases the strength, stiffness and ductility of the concrete column in a structure.

Accordingly, the present invention is directed to a method of repairing and strengthening a concrete column which comprises the steps of: (a) wrapping a flexible strap of reinforcing material circumferentially around the exterior of a concrete column and longitudinally along at least a portion of the height of the concrete column; and (b) fastening the flexible strap of reinforcing material to itself to secure it to the concrete column such that external lateral reinforcement of the concrete column is thereby provided which increases the strength, stiffness and ductility of the concrete column. The flexible strap of reinforcing material has a predetermined length, width and thickness. The length of the strap of reinforcing material is at least greater than the circumference of the concrete column, while the width of the strap of reinforcing material is substantially greater than thickness thereof.

The preferred components for construction of the flexible strap of reinforcing material employed in the method of the present invention are a plurality of strands each composed of fibers selected from the group consisting of carbon fiber, glass fiber, organic fiber, synthetic fiber and metal fiber, or a composite strand made up of combinations of such fibers. The strap can be formed of a plurality of individual strands, or strands weaved together. The strands can be oriented in the longitudinal direction, transverse direction, at an angle, or a combination of these directions along the length of the strap to form the desired weave pattern.

Also, the repairing and strengthening method further comprises the step of applying a tension force to the flexible strap of reinforcing material as it is being wrapped around the exterior of the concrete column. The tension force in the strap, which can range from close to zero to close to the tensile strength of its material, is preserved by use of a mechanical anchor or a chemical adhesive to attach the wrapped strap to itself.

The repairing and strengthening method also comprises the step of impregnating the flexible strap of reinforcing material with a resin. The resin can be applied before or during the wrapping operation or upon completion thereof.

Further, the flexible strap of reinforcing material wrapped around the concrete column can be provided in several different forms. In one form, the flexible strap of reinforcing material is composed of a plurality of separate, individual belts placed around the circumference of the concrete column in transverse relationship to the longitudinal axis of the concrete column and in side-by-side relationship to one another along the portion of the height of the concrete column. The individual belts can be placed in spaced-apart relationship or in edge-to-edge contacting relationship to one another.

In another form, the flexible strap of reinforcing material is a single belt placed around the circumference of the concrete column in spiraling relationship to the longitudinal axis of the column. The successive turns of the single belt can be placed in spaced-apart relationship or edge-to-edge overlapping relationship to one another.

Alternatively, in accordance with the method of the present invention, the flexible strap of reinforcing material can be a single belt wrapped about the concrete column at a small distance away from the exterior of the concrete column so as to provide an outer shell and create a gap between the column and the outer shell. To create the gap, spacers can be employed to allow the strap to be wrapped away from the periphery of the concrete column.

The gap between the concrete column and the outer shell can be filled with a variety of materials including, but not limited to, ordinary resin, ordinary grout, expansive resin, or expansive grout. When an expansive filler material is used, pressure will be generated in the gap upon curing of the filling material. A similar effect can result from filling the gap with pressurized filling material. This pressure will create prestressing and lateral compression of the concrete column for enhanced structural performance.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, wherein reference characters refer to the same parts throughout the various views of the invention, reference will be made to the attached drawings in which.

DETAILED DESCRIPTION OF THE PREFERRED EMBODIMENTS

Introduction

Figure 1:
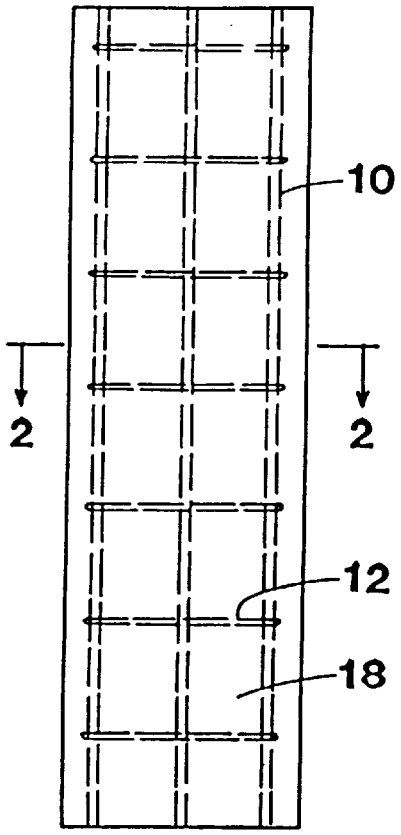
FIG. 1 PRIOR ART
FIG. 1 is an elevational view of a prior art rectangular concrete column, with internal longitudinal and lateral steel reinforcements being shown in broken line form.
Figure 3:
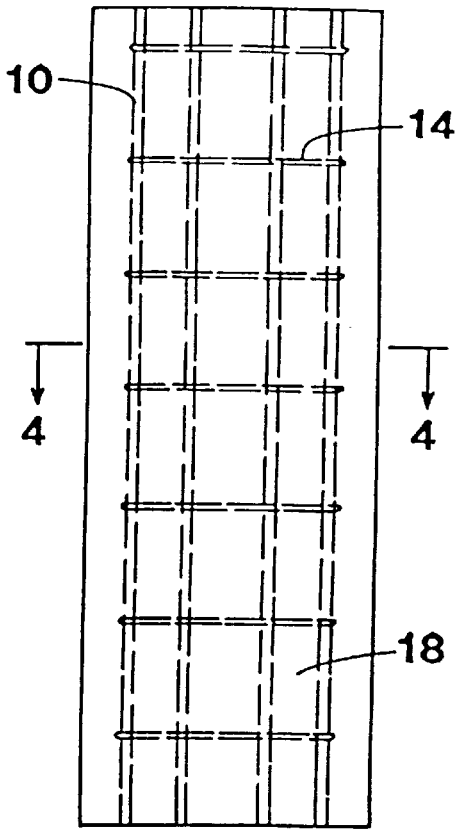
FIG. 3 PRIOR ART
FIG. 3 is an elevational view of a prior art circular reinforced concrete column, with internal longitudinal and lateral steel reinforcements being shown in broken line form.
Figure 2:
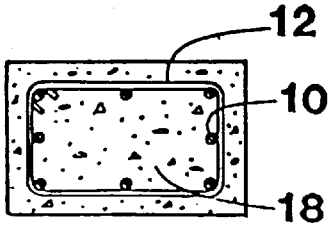
FIG. 2 PRIOR ART
FIG. 2 is a cross-sectional view taken along line 2—2 of FIG. 1.
Figure 4:
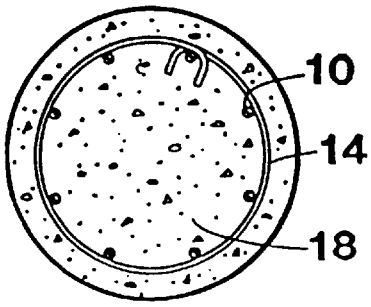
FIG. 4 PRIOR ART
FIG. 4 is a cross-sectional view taken along line 4—4 of FIG. 3.
Figure 5:
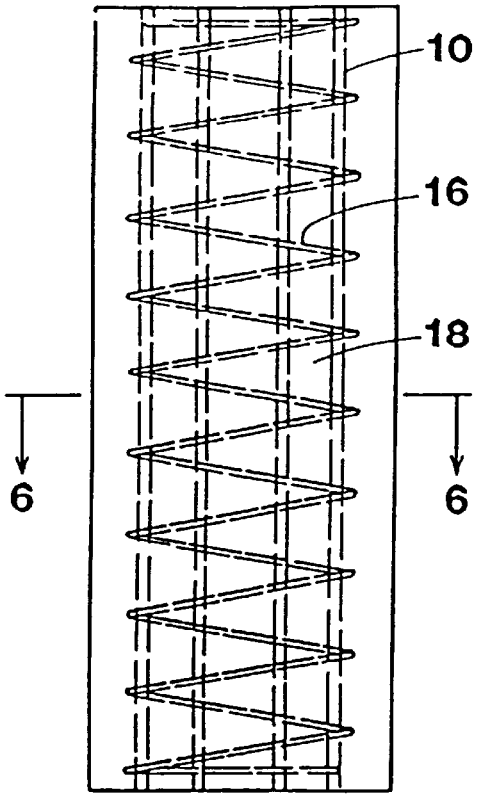
FIG. 5 PRIOR ART
FIG. 5 is an elevational view of a prior art circular reinforced concrete column, with internal longitudinal and spiral lateral steel reinforcement being shown in broken line form.
Figure 7:
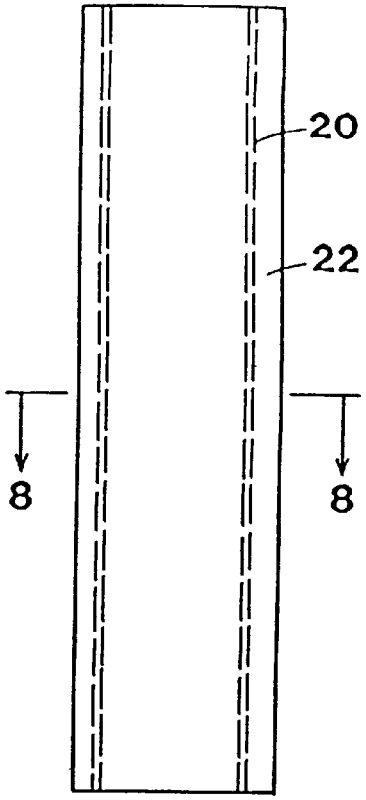
FIG. 7 PRIOR ART
FIG. 7 is an elevational view of a prior art rectangular composite concrete column, with a wide-flange steel reinforcement being shown in broken line form.
Figure 6:
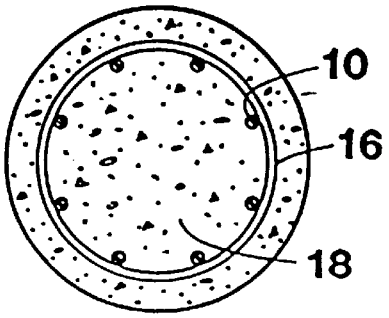
FIG. 6 PRIOR ART
FIG. 6 is a cross-sectional view taken along line 6—6 of FIG. 5.
Figure 8:
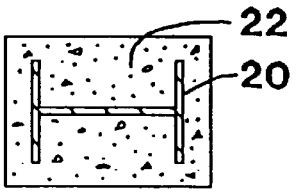
FIG. 8 PRIOR ART
FIG. 8 is a cross-sectional view taken along line 8—8 of FIG. 7.

Referring to the drawings, and particularly to FIGS. 9 through 20, there is illustrated a concrete column wrapped with a flexible strap of reinforcing material in accordance with the repairing and strengthening method of the present invention. The repairing and strengthening method basically comprises the steps of (a) wrapping the flexible strap of reinforcing material circumferentially about the exterior of a concrete column and longitudinally along at least a portion of the height of the concrete column, and (b) fastening the flexible strap to itself to secure it about the concrete column such that external lateral reinforcement of the concrete column is thereby provided which increases the strength, stiffness and ductility of the concrete column. The method also comprises the step of applying a tension force to the flexible strap of reinforcing material as it is being wrapped around the exterior of the concrete column. The method further comprises impregnating the flexible strap of reinforcing material with a resin by applying the resin to the flexible strap either before, during, or after completion of, the wrapping of the flexible strap around the concrete column.

Suitable equipment to use in applying both a tension force and a resin to the flexible strap of reinforcing material are within the understanding of one skilled in this art. One example of suitable equipment for applying the strap of reinforcing material under tension is an apparatus mounted on a stationary track encircling the concrete column. The apparatus orbits the column to wrap the flexible strap under tension about the column as the strap is paid out from a coil mounted on the apparatus and passes between a pair of rollers on the apparatus which grip the strap. A pair of applicator rollers can be employed on the apparatus at a location along the paid-out strap between the column and the pressure rollers for applying resin to the strap after it leaves the gripping rollers but before it reaches the column.

Also, resin impregnation can be performed in a number of ways including, but not limited to, the methods described here. In one case, the strap is pulled through a resin bath before being wrapped around the concrete column. In another case, the strap can be wrapped around the concrete column and then resin applied to the strap by means of spraying or brushing. In both of these cases, after the resin is cured, the strap can form a solid shell around the column. In another case, the strap can take the form of pre-pregnated tapes that are wrapped around the concrete column. Such tapes are usually available with a backing which can be removed in the field to initiate the curing of the epoxy. In all of these cases, the concrete column surface could also be pre-coated with a layer of resin prior to the application of the strap.

The flexible strap of reinforcing material has a predetermined length, width and thickness. The length of the strap of reinforcing material is at least greater than the circumference of the concrete column, whereas the width of the strap is substantially greater than thickness of the strap.

The preferred components for construction of the flexible strap of reinforcing material employed in the method of the present invention are a plurality of strands. Nonmetallic materials are preferred for the construction of the strands, although metallic materials and combinations of nonmetallic and metallic materials can be used as well. Each stand is composed of fibers selected from a group consisting of carbon fibers, graphite fibers, glass fibers, organic fibers, synthetic fibers and metal fibers, or composite fibers made up of combinations of such fibers. The strap can be formed of a plurality of individual strands, or strands weaved together. The strands can be oriented in the longitudinal direction, transverse direction, at an angle, or any combination of these directions along the length of the strap to form the desired weave pattern.

Embodiments of FIGS. 9 through 12

Figure 9:
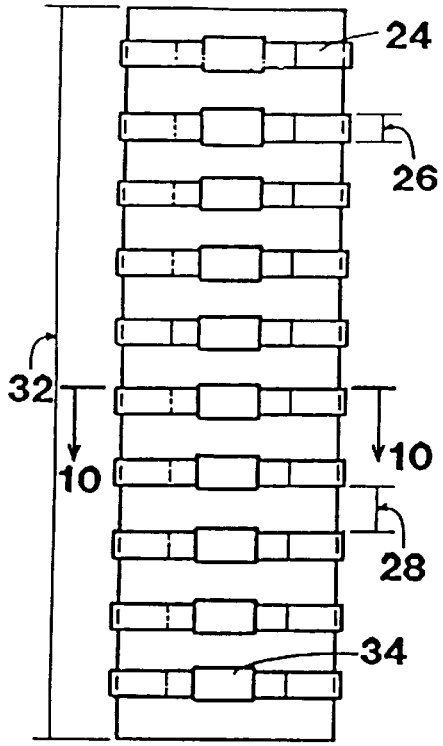
FIG. 9 is an elevational view of a rectangular concrete column strengthened with non-overlapping individual straps of reinforcing material in accordance with the method of the present invention, but with internal longitudinal and lateral steel reinforcements omitted for purposes of clarity (as is also the case in subsequent FIGS. 10 through 23)
Figure 11:
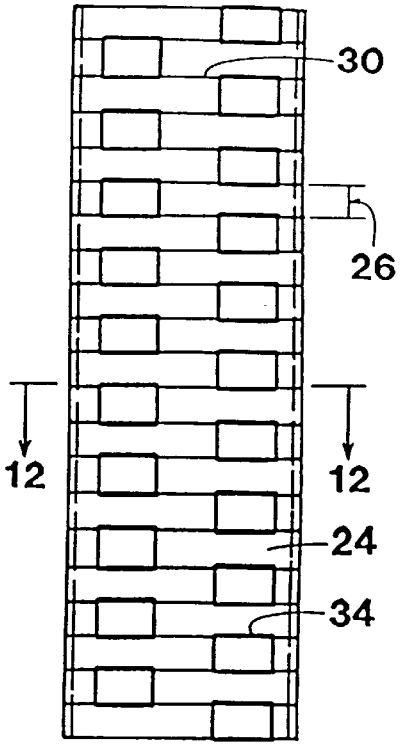
FIG. 11 is an elevational view of a circular concrete column strengthened with edge-to-edge individual straps of reinforcing material in accordance with the method of the present invention.
Figure 10:
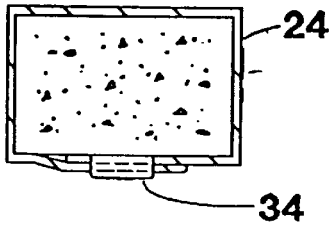
FIG. 10 is a cross-sectional view taken along line 10—10 of FIG. 9.
Figure 12:
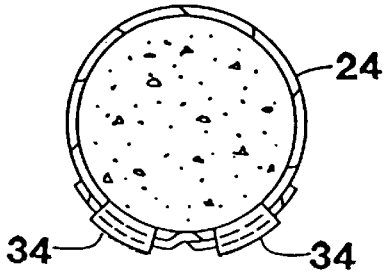
FIG. 12 is a cross-sectional view taken along line 12—12 of FIG. 11.

Referring to FIGS. 9 through 12, one preferred method is to wrap around the concrete column in a transverse relationship to a longitudinal axis thereof, a flexible strap of reinforcing material in the form of a plurality of flexible belts 24 of desired width 26. The flexible belts 24 of reinforcing material are wrapped circumferentially about the exterior of the concrete column and longitudinally along the height of the concrete column in either one of two relationships. As shown in FIGS. 9 and 10, the belts 24 are placed from one another at selected spacing 28. As shown in FIGS. 11 and 12, the belts 24 are placed edge-to-edge 30, nearly or actually in contact with one another.

The width of each belt 24 is greater than the thickness thereof which serves to distribute the stresses generated by the belts over larger portions of the surface area of the concrete column. The thickness of each belt 24 is less than one inch, falling preferably within the range of from one-tenth to three-fourths of an inch. The width of each belt 24 is greater than one inch, falling preferably within the range of from several inches up to as large as the full height 32 of the concrete column (in the latter case only one belt would be wrapped around the column). Also, the width of each belt 24 need not remain constant along the full height 32 of the column.

The flexible belts 24 of reinforcing material are preferably wrapped while applying a tension force to them. The magnitude of this tension force can vary from close to zero to close to the tensile strength of the belt. The tension force in each belt 24 is preserved by means of an operative closure mechanism 34, such as a buckle or clamp, that couples the two ends of the belt to one another. Instead of, or in addition to, the operative mechanism 34, a suitable chemical adhesive can be used to attach the two ends together and preserve the tension force in the belt 24.

Preferably, each belt 24 is wrapped around the concrete column at least one complete turn. Also, each belt 24 can be wrapped several times in overlaying fashion. Protective coatings can be applied to the belts 24 for improved durability and resistance to aggressive environmental factors and fire. The belts 24 can also be impregnated with a suitable resin to create a solid shell, in the case of the belts 24 placed in edge-to-edge relationship, around the concrete column for improved structural performance. In addition, new concrete can be overlaid on the outer surface of the concrete column to provide additional strength and stiffness and also protect against adverse environmental conditions and fire.

Embodiments of FIGS. 13 through 18

Figure 13:
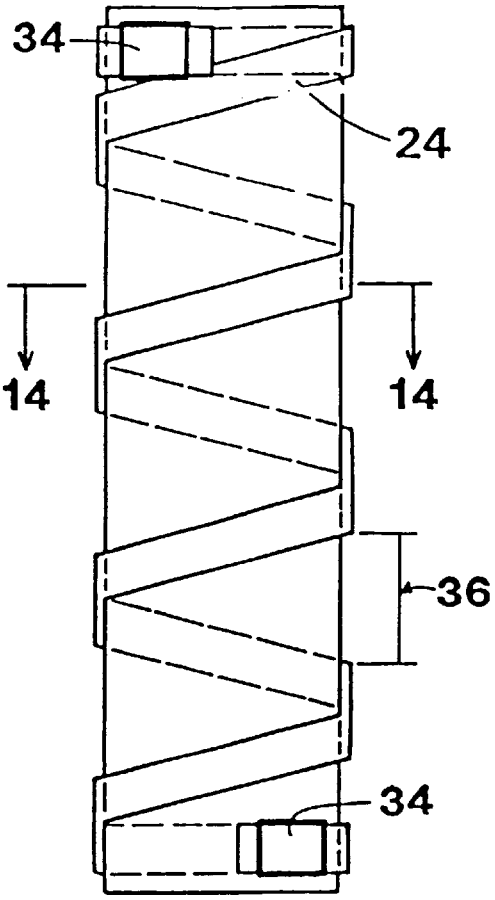
FIG. 13 is an elevational view of a rectangular concrete column strengthened with a non-overlapping spiraling continuous strap of reinforcing material in accordance with the method of the present invention.
Figure 15:
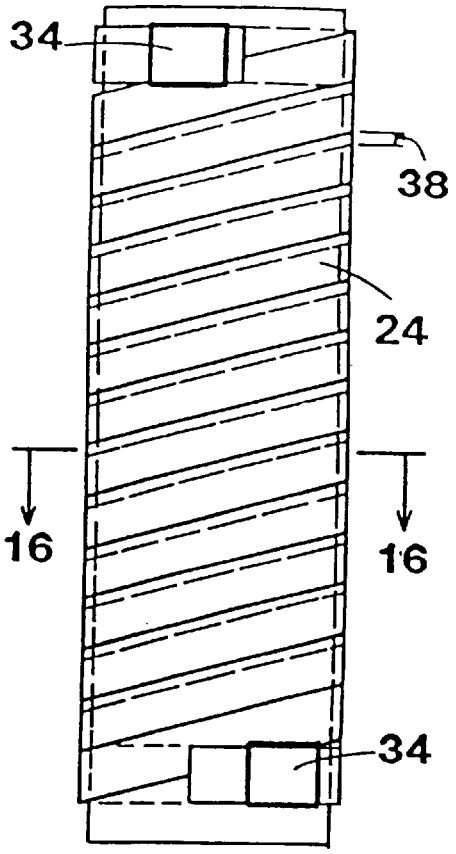
FIG. 15 is an elevational view of a circular concrete column strengthened with an overlapping spiraling continuous strap of reinforcing material in accordance with the method of the present invention.
Figure 14:
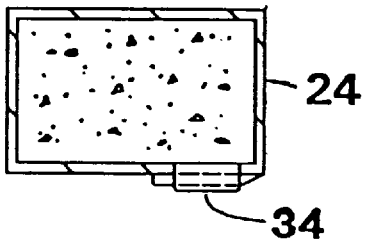
FIG. 14 is a cross-sectional view taken along line 14—14 of FIG. 13.
Figure 16:
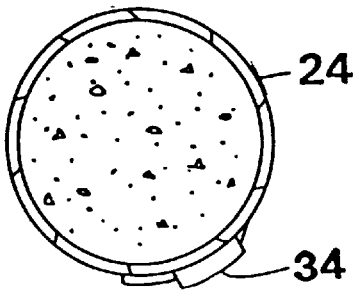
FIG. 16 is a cross-sectional view taken along line 16—16 of FIG. 15.

Referring to FIGS. 13 through 16, another preferred method is to wrap around the concrete column, in a spiraling relationship to the longitudinal axis thereof, a flexible strap of reinforcing material in the form of a single flexible belt 24. The single flexible belt 24 of reinforcing material is wrapped circumferentially about the exterior of the concrete column and longitudinally along the height of the concrete column in either one of two continuous spiraling relationships. As shown in FIGS. 13 and 14, the successive turns of the belt 24 are placed from one another at selected spacing 36. As shown in FIGS. 11 and 12, the turns of the single belt 24 are placed in overlapping edge-to-edge contacting relation 38.

The width-to-thickness relationship of the single spirally wrapped belt 24 can be the same as that described above with respect to each of the plurality of individual transversely wrapped belts 24 of FIGS. 9 through 12. Also, tension force can be applied to the spirally wrapped belt 24 and preserved therein in the same manner as described above in the case of the transversely wrapped belts 24. Further, resin can be applied to the spirally wrapped belt 24 in the same fashion as described above in the case of the transversely wrapped belts 24.

Figure 17:
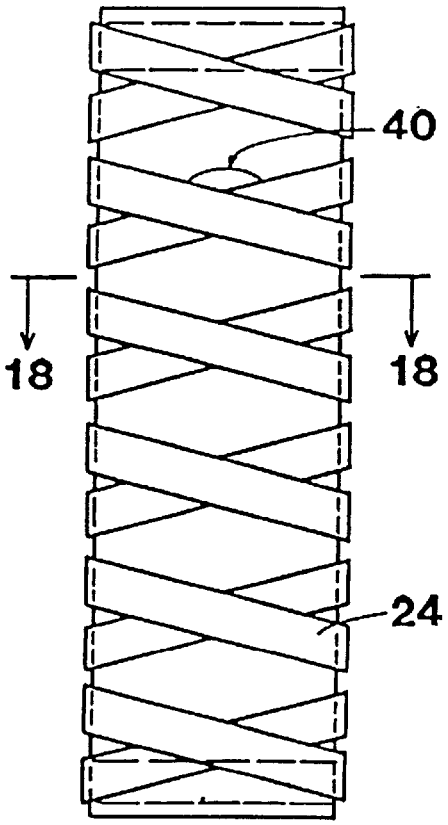
FIG. 17 is an elevational view of a circular concrete column strengthened with crossing spiraling individual continuous straps of reinforcing material in accordance with the method of the present invention.
Figure 18:
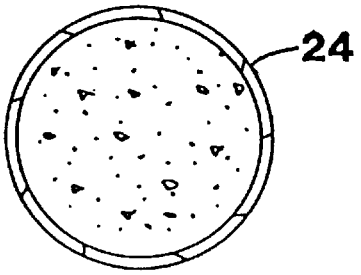
FIG. 18 is a cross-sectional view taken along line 18—18 of FIG. 17.

The single belt 34 is wrapped around the height of the concrete column at least once. However, this operation can be repeated for the same column more than one time. If the operation is repeated more than once, a preferred method is to cross the belt 24 as shown in FIGS. 17 and 18. The angle of crossing for the turns of the belt 24 can range from zero to 1800. The durability of the spirally wrapped belt 24, its protection against adverse environmental conditions and fire, and its structural performance can be improved in the same manner as described in the case of the transversely wrapped belts 24.

Figure 19:
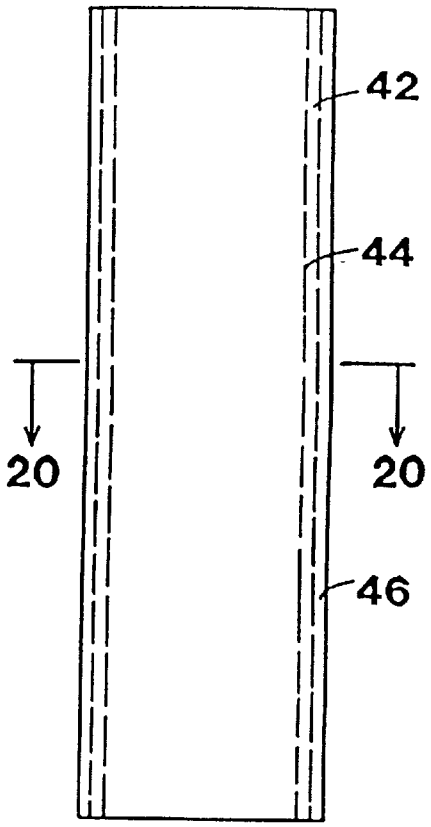
FIG. 19 is an elevational view of a rectangular concrete column surrounded by a shell constructed of resin-impregnated strands of reinforcing material in accordance with the method of the present invention.
Figure 20:
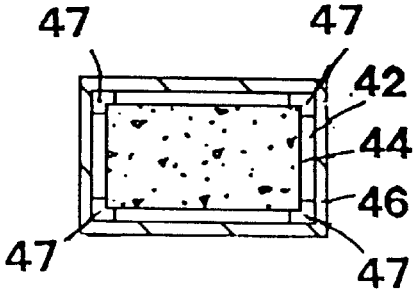
FIG. 20 is a cross-sectional view taken along line 20—20 of FIG. 19.

Embodiment of FIGS. 19 and 20

Referring to FIGS. 19 and 20, still another preferred method is to wrap around the concrete column, in an outwardly spaced relationship therefrom, a flexible strap of reinforcing material in the form of another single flexible belt. The outwardly spaced relationship of the single flexible belt creates a gap 42 around the exterior or outer surface 44 of the concrete column and takes on the form of an outer shell 46 about the concrete column. A plurality of spacers 47 are placed in spaced relation from one another about the concrete column to assist in forming the single belt into the shell 46. The outer shell 46 defined by the single flexible belt has a length substantially equal to the desired height of the concrete column to be strengthened.

The gap 42 between the concrete column and the outer shell 46 can be filled with a variety of materials including, but not limited to, ordinary resin, ordinary grout, expansive resin, or expansive grout. When an expansive filler material is used, pressure will be generated in the gap 42 upon curing of the filling material. A similar effect can result from filling the gap 42 with pressurized filling material. This pressure will create prestressing and lateral compression of the concrete column for enhanced structural performance.

The filling material can be injected into the gap 42 through a port hole or holes (not shown) in the bottom of the outer shell 46 while vacuum is drawn from a port hole or holes (not shown) located at the top of the shell 46 to ensure complete filling of the gap 42. In addition, when the gap 42 is fully filled with the filling material, the top port hole or holes could be closed while more filling material is pressure-injected into the gap 42 from the bottom port hole or holes to create an internal pressure in the gap 42 which places the shell 46 in tension. The bottom port hole or holes can then be closed to retain the pressure in the filling material in the gap 42. This internal pressure will also act as lateral pressure on the concrete column surfaces which improves their strength, stiffness and ductility.

The thickness of the outer shell 46 can be the same as that described above with respect to each of the plurality of individual transversely wrapped belts 24 of FIGS. 9 through 12. Also, a tension force can be applied to the outer shell 46 and preserved therein in the same manner as described above in the case of the transversely wrapped belts 24. Further, resin can be applied to the outer shell 46 in the same fashion as described above in the case of the transversely wrapped belts 24.

Figure 21:
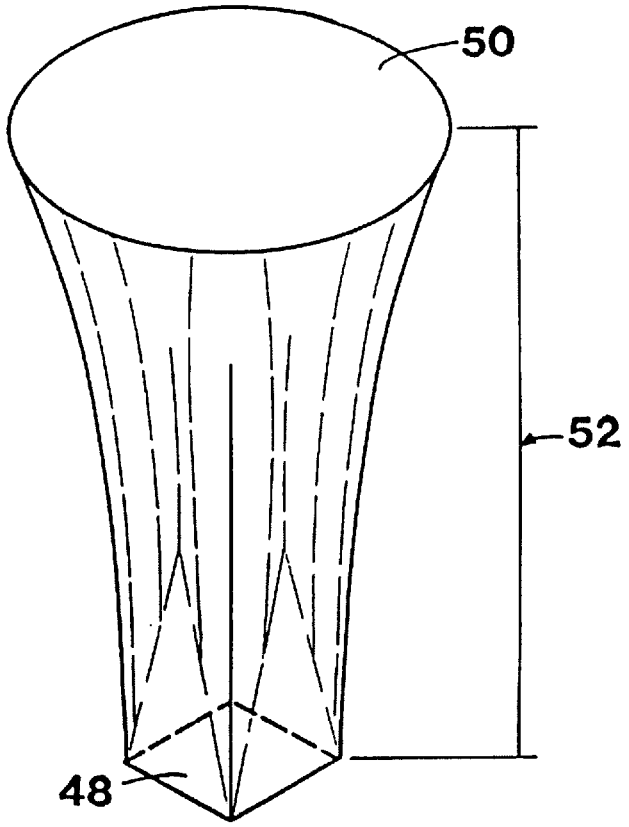
FIG. 21 is an isometric view of a concrete column with varying cross-sectional size and shape along its height.
Figure 22:
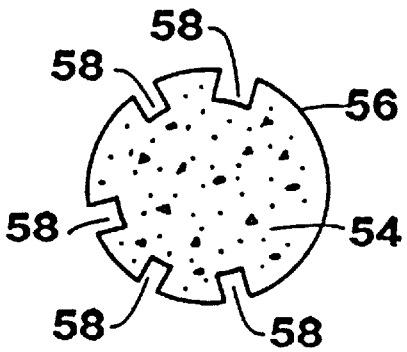
FIG. 22 is a cross-sectional view of a circular concrete column with architectural or functional details on the outer surface.
Figure 23:
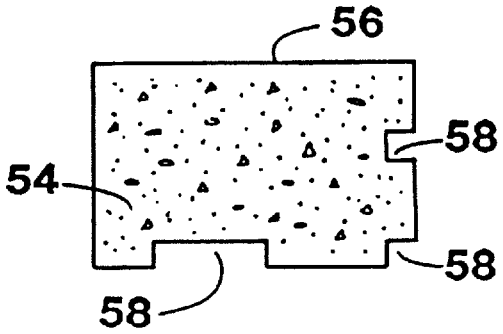
FIG. 23 is a cross-sectional view of a rectangular concrete column with architectural or functional details on the outer surface.

Embodiment of FIGS. 21 through 23

Referring to FIGS. 21 through 23, there is illustrated other cross-sectional configurations of concrete columns with respect to which the repair and strengthening method of the present invention can be employed. These cross-sectional shapes include but are not limited to solid or hollow triangle, square, rectangle, diamond, trapezoid, circle, ellipse, and polygon. As shown in FIG. 21, the method can be applied to a concrete column having varying cross-sectional shape and size 48 and 50 along its height or length 52.

When the outside surfaces of the concrete column are flat, for example in columns with rectangular cross-sections, a preferred method is to place spacers between the surface of the column and the flexible strap of reinforcing material. The spacers include but are not limited to those having one flat surface to bear against the flat surface of the column and opposite surfaces of the spacer being convex and bearing against the strap. This will ensure that a portion of the tensile force in the strap will always act perpendicular to the surface of the column, resulting in lateral compression for improved structural performance of the column.

As shown in FIGS. 22 and 23, the outer surfaces of the concrete column cross-section 54 can be either flat 56 or can have architectural or functional details including but not limited to recesses or indentations 58. When the outer surface of the column is not flat, fillers can be provided in the recessed areas to allow the transfer of force from the strap to the concrete column.

Advantages of the Method of the Present Invention

The method of the present invention has several advantages over the prior art methods for repairing and strengthening concrete columns. These advantages include, but are not limited to, the following:

1. Increased strength

The lateral confinement and pressure provided by the flexible strap of reinforcing material will increase the compressive strength of the concrete in both the core and shell regions, resulting in higher axial load carrying capacity for the concrete column. In addition, the initial lateral pressure will delay formation and growth of shear cracks and, hence, it will increase the shear strength of the concrete column. The lateral confinement provided by the flexible strap will also provide additional support against buckling of the longitudinal reinforcement bars.

2. Increased stiffness

The lateral stresses induced by the flexible strap of reinforcing material will reduce cracking and, therefore, will increase the flexural rigidity or stiffness, EI, of the concrete column. This will improve the overall behavior of concrete columns.

3. Increased ductility

As a result of the confinement and lateral prestress provided by the flexible strap of reinforcing material, the concrete will fail at a larger strain than if unconfined. Depending on the degree of confinement and lateral pressure, significant increase in ductility can be achieved.

4. Cross-sectional shape

The flexibility of the strap of reinforcing material allows wrapping around concrete columns of any cross-sectional shape including but not limited to hollow or solid triangles, squares, rectangles, diamonds, trapezoids, circles, ellipses, and polygons. In addition, the flexible strap of reinforcing material can be wrapped around concrete columns which have varying cross-sectional shape and size along their heights or lengths.

5. Low maintenance

Because of resistance to electrochemical deterioration, the flexible strap of nonmetallic reinforcing material is not affected by salt spray, moisture and other aggressive environmental factors; therefore, no corrison protection will be necessary. Some nonmetallic materials may need protection against ultraviolet rays and fire. Such protection can be provided by means of painting or coating.

6. Light weight

The light weight of nonmetallic materials will greatly simplify the construction and repair or strengthening procedure and cost. The light weight will also result in little addition to the self weight of the structure.

7. Flexibility

Nonmetallic materials are generally more flexible than steel. The advantages of nonmetallic materials include but are not limited to their ability to be wrapped around corners of concrete columns with non-circular cross-sections.

8. Temporary vs. permanent

The application of the flexible strap of reinforcing material will cause no disturbance to the integrity of the existing structure, since no anchor bolts, dowels, etc., will be required. As a result, the flexible strap of reinforcing material can be used as either a permanent or temporary repair or strengthening measure. For example, if at a later time, more effective repair of strengthening alternatives are developed, the strap can be easily removed. The removal of the strap can also be easily performed after an earthquake to inspect the extent of damage sustained by the concrete column.

9. Aesthetics

The flexible strap of reinforcing material is relatively thin; therefore, it will not alter the appearance of the structure. If desired, a layer of concrete or paint or other coatings can be applied to cover the strap. Furthermore, the strap will increase the concrete column dimensions very slightly. This is in contrast to other repair and strengthening methods which result in a significant increase in concrete column dimensions.

10. New designs

The benefits of external lateral prestressing can also be utilized in new designs. For example, laterally prestressing the concrete columns in a structure will result in higher axial load strength and higher shear strength. Therefore, a smaller column cross-section or thinner wall thickness can be used. This will result in less required concrete and a lighter structure. Such lateral prestressing can be more advantageous than using high-strength concrete, because high-strength concrete is more brittle than ordinary-strength concrete.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A method of repairing and strengthening a concrete column, comprising:

(a) wrapping a flexible strap of reinforcing material circumferentially around the exterior of a concrete column and longitudinally along at least a portion of the height of the concrete column; and (b) fastening said flexible strap of reinforcing material to itself to secure it to the concrete column such that external lateral reinforcement of the concrete column is thereby provided which increases the strength, stiffness and ductility of the concrete column;

(c) said flexible strap of reinforcing material having a predetermined length, width and thickness, the length of said strap being at least greater than the circumference of the concrete column, the width of said strap, at the time of wrapping, being substantially greater than the thickness of said strap.

2. The method of claim 1 wherein said wrapping includes wrapping a flexible strap of reinforcing material in the form of a flexible belt of reinforcing material about the concrete column, said flexible belt extending in transverse relationship to a longitudinal axis of the concrete column.

3. A method of reinforcing a concrete structural element, comprising:

wrapping flexible reinforcing material, in strap form, on the exterior of the concrete structural element such that the reinforcing material covers at least a portion of the height of the structural element; and securing said flexible reinforcing material on the structural element such that the structural element is thereby provided with external lateral reinforcement;

said strap form of said flexible reinforcing material having a predetermined length, width and thickness, such that at the time of wrapping the width is substantially greater than the thickness.

4. The method of claims 1 or 3 wherein said reinforcing material includes a plurality of strands, each strand being composed of fibers selected from the group consisting of carbon fiber, glass fiber, organic fiber, synthetic fiber and metal fiber, or combinations of said fibers.

5. The method of claims 1 or 3 further comprising applying a tension force to said flexible reinforcing material during wrapping.

6. The method of claim 5 wherein the tension force applied to said flexible reinforcing material ranges from a magnitude greater than zero to a magnitude approaching the tensile strength of said flexible reinforcing material.

7. The method of claim 5 wherein said wrapped flexible reinforcing material is fastened to itself by use of a mechanical anchor.

8. The method of claims 1 or 3 wherein said wrapped flexible reinforcing material is secured, at least in part, using a chemical adhesive.

9. The method of claims 1 or 3 further comprising:

impregnating said flexible reinforcing material with a resin by applying the resin to said flexible reinforcing material.

10. The method of claim 9 wherein said resin is applied either before, during, or after completion of, said wrapping of said flexible reinforcing material.

11. The method of claim 3 wherein said wrapping includes wrapping flexible reinforcing material in the form of a single flexible belt of reinforcing material on the structural element spaced from the exterior of the structural element by a plurality of spacers as to define an outer shell spaced by a gap between the structural element and said outer shell, said outer shell defined by said single belt having a length substantially equal to the height of said portion of the structural element.

12. The method of claim 11 further comprising:

filling the gap between the concrete column and said outer shell with an expansive material.

13. The method of claims 1 or 3 wherein said wrapping includes wrapping in a spiral flexible reinforcing material in the form of a single continuous belt.

14. The method according to claims 1 or 3, wherein the flexible reinforcing material is woven.

15. The method according to claims 1 or 3, wherein the flexible reinforcing material is made up of a plurality of strands, the strands being oriented in the longitudinal direction of the reinforcing material.

16. The method of claims 1 or 3, wherein wrapping includes applying the flexible reinforcing material in a plurality of individually wrapped belts.

17. The method of claims 1 or 3, wherein the reinforcing material is pre-pregnated tape.

18. The method according to claims 1 or 3, wherein resin is applied to the reinforcing material.

19. The method according to claims 1 or 3, wherein the reinforcing material is a composite made of varying types of fibers.

20. The method according to claims 1 or 3, wherein the reinforcing material is progressively wrapped in an edge-to-edge orientation.

21. The method according to claims 1 or 3, wherein during wrapping, spaces are purposefully left between edges of the reinforcing material.

22. The method according to claims 1 or 3, wherein the flexible reinforcing material has a minimum thickness of less than an inch.

23. The method according to claim 14, wherein the width of at least some of the reinforcing material varies along a length of the reinforcing material.

24. The method according to claims 1 or 3, wherein the reinforcing material is wrapped in an overlapping manner.

25. The method according to claims 1 or 3, wherein a fire protective substance is applied to the reinforcing material.

26. The method according to claims 1 or 3, wherein an ultraviolet-ray protective substance is applied to the reinforcing material.

27. The method according to claims 1 or 3, wherein a layer of paint is applied to the reinforcing material after wrapping.

28. The method according to claims 1 or 3, further comprising, prior to wrapping, the step of coating a surface onto which the flexible material is to be wrapped.

29. The method according to claim 3, wherein the reinforcing material is used in constructing a new structural element to thereby permit the use of a newly constructed structural element with dimensions smaller than would otherwise be required in an absence of reinforcing material.

30. The method according to claims 1 or 3, wherein the strap form of the reinforcing material has a width of between about one inch and a height of a surface on which the reinforcing material is to be wrapped.

31. A method of repairing and strengthening a concrete column, comprising the steps of:

(a) wrapping a flexible strap of reinforcing material of high-strength stretchible fibers at an angle circumferentially around the exterior of a concrete column and longitudinally along at least a portion of the height of the concrete column and spaced from the exterior of the concrete column;

(b) fastening said flexible strap of reinforcing material to itself and applying a resin to said flexible strap so as to define an outer shell spaced by a gap between the concrete column and said outer shell; and (c) filling said gap between the concrete column and said outer shell with an expansive material for generating a pressure in said gap upon curing of said material to cause prestressing and lateral compression of the concrete column for enhanced structural performance.

32. The method of claim 31 wherein said strap of reinforcing material includes a plurality of strands, each strand being composed of fibers selected from the group consisting of carbon fiber, glass fiber, organic fiber, synthetic fiber and metal fiber, or combinations of said fibers.

33. The method of claim 31 wherein said resin is applied either before, during, or after completion of, said wrapping of said flexible strap around the concrete column.

34. The method of claim 31 wherein said wrapping includes wrapping a flexible strap of reinforcing material in the form of a single continuous belt of reinforcing material about the concrete column in spiraling relationship to the longitudinal axis of the column.

35. The method of claim 34 wherein said continuous belt is placed in spirals having edge-to-edge contacting relationship to one another.

36. The method of claim 34 wherein said belt of reinforcing material is placed in spirals having edge-to-edge overlapping relationship to one another.

37. A method of reinforcing a concrete structural element, comprising:

wrapping flexible reinforcing material, in strap form, on the structural element wherein, at the time of wrapping, a width of the reinforcing material wrapped on the structural element is substantially greater than a thickness of the reinforcing material; and securing the reinforcing material to the concrete column to thereby provide lateral reinforcement to the structural element.

38. A method for reinforcing a structural element, the method comprising:

applying a resinous substance to flexible reinforcing material;

wrapping the flexible reinforcing material on the structural element;

forming, with the reinforcing material and the resinous material, a hardened shell on at least a portion of the structural element; and applying a protective coating to the hardened shell.

39. The method according to claim 38, wherein the protective coating blocks ultraviolet rays.

40. The method according to claim 38, wherein the protective coating is a fire retardant.

41. The method according to claim 38, wherein the protective coating is an aesthetic paint.

* * * * *